US009661940B2

(12) United States Patent
Schneider et al.

(10) Patent No.: US 9,661,940 B2
(45) Date of Patent: May 30, 2017

(54) GLASS ELEMENT FOR A CABINET HAVING A REFRIGERATED CHAMBER

(71) Applicant: AGC GLASS EUROPE, Louvain-la-Neuve (BE)

(72) Inventors: Pierre Schneider, Romagne (FR); Nicolas Boucher, Brussels (BE); Olivier Bouesnard, Ittre (BE)

(73) Assignee: AGC GLASS EUROPE, Louvain-la-Neuve (BE)

( * ) Notice: Subject to any disclaimer, the term of this patent is extended or adjusted under 35 U.S.C. 154(b) by 0 days.

(21) Appl. No.: 14/898,023

(22) PCT Filed: May 28, 2014

(86) PCT No.: PCT/EP2014/061128
§ 371 (c)(1),
(2) Date: Dec. 11, 2015

(87) PCT Pub. No.: WO2014/198549
PCT Pub. Date: Dec. 18, 2014

(65) Prior Publication Data

US 2016/0120336 A1 May 5, 2016

(30) Foreign Application Priority Data

Jun. 14, 2013 (BE) ..... 2013/0421

(51) Int. Cl.
*E06B 3/00* (2006.01)
*A47F 3/04* (2006.01)
(Continued)

(52) U.S. Cl.
CPC ..... *A47F 3/0434* (2013.01); *A47F 3/005* (2013.01); *A47F 3/043* (2013.01); *E04B 1/6801* (2013.01);
(Continued)

(58) Field of Classification Search
CPC ..... A47F 3/0434; A47F 3/043; E06B 3/025; E06B 3/481; E06B 3/5409; E06B 3/66; E06B 3/66304; E06B 7/16
See application file for complete search history.

(56) References Cited

U.S. PATENT DOCUMENTS 3,335,784 A * 8/1967 Risk ..... E06B 3/481 160/199
4,660,903 A * 4/1987 Shinagawa ..... A47F 3/0434 312/116
(Continued)

FOREIGN PATENT DOCUMENTS

DE 30 48 763 8/1982
DE 94 11 674 10/1994
(Continued)

OTHER PUBLICATIONS

International Search Report issued Jul. 17, 2014 in PCT/EP2014/061128 filed May 28, 2014.

*Primary Examiner* — Daniel Rohrhoff
(74) *Attorney, Agent, or Firm* — Oblon, McClelland, Maier & Neustadt, L.L.P.

(57) ABSTRACT

The invention relates to a glass element (200) including at least one insulating glass panel including at least one first (10) and one second (11) glass sheet combined with one another via a spacer (12) which keeps same spaced apart from one another, said spacer extending along the side, upper and lower edges of said two glass sheets and between said at least two glass sheets, at least one inner space (15) including a layer of an insulating gas and closed by a first (13) and a second (14) peripheral seal arranged around said inner space, and at least one frame (201) which supports said at least one insulating glass panel, said frame including (i) a stationary bracket (21) and (ii) a movable bracket (22) which is hinged on the stationary bracket and which allows
(Continued)

the opening and/or the closing of the glass element. Such a glass element includes a spacer (12), the first (13) and the second (14) peripheral seal extending along at least one of the side edges of said at least two glass sheets are formed from a transparent resin, and said movable bracket is devoid of at least one side crosspiece.

14 Claims, 4 Drawing Sheets

(51) Int. Cl.

| | |
|---|---|
| ***E06B 3/48*** | (2006.01) |
| ***E06B 3/02*** | (2006.01) |
| ***A47F 3/00*** | (2006.01) |
| ***E04B 1/68*** | (2006.01) |
| ***E06B 3/54*** | (2006.01) |
| ***E06B 3/663*** | (2006.01) |
| ***E06B 3/677*** | (2006.01) |
| ***E06B 7/16*** | (2006.01) |

(52) U.S. Cl.
CPC ..... *E06B 3/025* (2013.01); *E06B 3/481* (2013.01); *E06B 3/5409* (2013.01); *E06B 3/663* (2013.01); *E06B 3/677* (2013.01); *E06B 7/16* (2013.01)

(56) References Cited

U.S. PATENT DOCUMENTS

| | | | | |
|---|---|---|---|---|
| 4,878,530 | A * | 11/1989 | Jean | A47K 3/34 160/211 |
| 5,363,611 | A * | 11/1994 | Richardson | A47F 3/043 312/116 |
| 6,435,630 | B1 * | 8/2002 | Anin | A47F 3/0434 312/116 |
| 6,655,760 | B1 * | 12/2003 | Sakata | A47F 3/043 312/116 |
| 2012/0291471 | A1 * | 11/2012 | Giulietti | E06B 3/367 62/255 |
| 2014/0224435 | A1 * | 8/2014 | Stawski | E05D 15/0621 160/188 |
| 2016/0053528 | A1 * | 2/2016 | Dick | E06B 3/66319 428/34 |
| 2016/0083092 | A1 * | 3/2016 | Long | B64C 1/1469 160/213 |

FOREIGN PATENT DOCUMENTS

| | | |
|---|---|---|
| DE | 20 2004 001 795 | 4/2004 |
| DE | 10 2008 010 586 | 8/2009 |
| FR | 1 118 140 | 5/1956 |

* cited by examiner

GLASS ELEMENT FOR A CABINET HAVING A REFRIGERATED CHAMBER

1. FIELD OF THE INVENTION

The field of the invention is that of insulating glazed elements for a refrigerated chamber cabinet. These glazed elements may be used in any type of application such as glazings for refrigerator doors, freezer doors, or else utilitarian glazings.

2. SOLUTIONS OF THE PRIOR ART

The refrigerated chamber cabinet, also referred to as a refrigerated cabinet, used in most commercial premises for offering for sale and/or consumption products that must be kept at temperatures below 10° C., such as foodstuffs, is often equipped with glazed elements that convert it into a refrigerated display cabinet. These cabinets allow the products to be viewed by the consumer/customer and in particular allow a self-service use while keeping the products at a given temperature. The refrigerated cabinet thus represents the last link in the food cold chain before the product comes into the possession of the consumer. The development of products and in particular of foodstuffs is of prime importance but this must not take place at the expense of the quality of their storage. In other words, the refrigerated cabinet is used to show and/or display the products in a net volume at a given storage temperature (in general below 10° C.).

Thus, the display of products and more particularly of foodstuffs has an essential role in the sale of the products. A good display has in particular a good visual access to the products contained in the refrigerated chamber cabinet, without having to open it. However, while displaying the products, the refrigerated chamber cabinet must maintain the temperature and ensure the preservation of the products that must be chilled or frozen. Thus, owing to the laws of thermodynamics and conversely to the display function, the cabinets must at the very least protect the products against thermal stresses of all sorts, such as the closing and opening of the doors. However, technically speaking, the roles of displaying and preserving the products at a given temperature in refrigerated chamber cabinets are in complete contradiction since the consumer must be able to have available products contained in the refrigerated chamber cabinet while benefiting from a refrigerated chamber cabinet having a wide opening and that is well lit, and the storekeeper must ensure a storage quality of the products with, as a priority, the closure or the reduction of the openings of the cabinets as much as possible, the least lighting possible and more particularly the fewest heat exchanges with the store surroundings.

Thus, several solutions have been envisaged in order to improve the thermal insulation performance of these glazed elements used for the refrigerated chamber cabinets, such as the use of vacuum glazing, the use of layers that reflect the infrared radiation or else triple glazings, of which one of the gas-filled cavities may be filled with krypton. However, the energy efficiency of such equipment still needs to be improved and the use of such multiple glazings, due to their thickness and their weight, generally requires the use of a support frame that gives them a good mechanical strength but which creates significant bulkiness.

3. OBJECTIVES OF THE INVENTION

An objective of the invention is in particular to overcome these disadvantages of the prior art.

More specifically, one objective of the invention, in at least one of its embodiments, is to provide an opening glazed element for a refrigerated chamber cabinet which is inexpensive while retaining good thermal insulation properties for longer than the glazed elements used conventionally.

Another objective of the invention, in at least one of its embodiments, is to use such an opening glazed element that offers a wide opening for a refrigerated chamber cabinet while avoiding as much as possible heat exchanges with the external surroundings.

Another objective of the invention, in at least one of its embodiments, is to provide an opening glazed element for a refrigerated chamber cabinet which makes it possible to ensure effective preservation of the products contained in the refrigerated cabinet while reducing the energy consumption for maintaining the required temperature inside the refrigerated chamber cabinet.

The invention, in at least one of its embodiments, also has the objective of providing such a glazed element that makes it possible to optimize the energy efficiency of the refrigerated cabinets while retaining the role of displaying the products contained in the refrigerated chamber cabinet.

Another objective of the invention is to produce a refrigerated chamber cabinet that meets the tightness criteria for these types of cabinets and that offers a production that is easy to implement and economically advantageous.

4. SUMMARY OF THE INVENTION

In accordance with one particular embodiment, the invention relates to a glazed element comprising:

a. at least one insulating glazing comprising at least a first glass sheet and a second glass sheet joined together by means of a spacer which keeps them at a certain distance from one another, said spacer extending along the lateral, upper and lower edges of said at least two glass sheets and, between said at least two glass sheets, at least one internal space that comprises a cavity filled with an insulating gas and that is closed by a first peripheral seal and a second peripheral seal that are positioned around said internal space, b. at least one frame that supports said at least one insulating glazing, said frame comprising:

i. a fixed support and ii. a mobile support hinged to the fixed support that enables the opening and/or closing of the glazed element.

According to the invention, one such glazed element comprises a spacer (12), the first peripheral seal (13) and the second peripheral seal (14) extending along at least one of the lateral edges of said at least two glass sheets are formed from a transparent resin, and said mobile support lacks at least one lateral crosspiece.

The general principle of the invention is based on the use in a glazed element of a spacer, of peripheral seals in a multiple glazing that are transparent and also a mobile support that supports the glazing that lacks at least one lateral crosspiece while offering an effective solution from a thermal insulation viewpoint.

Such a glazed element has the advantage of offering a larger transparent surface area due to the absence of at least one lateral crosspiece on the mobile support and the presence of a transparent spacer and transparent peripheral seals while enabling a reduction in energy consumption.

The use of multiple glazing for refrigerated cabinets is already known. However, the glazings are within a frame in order to maintain a sufficient thermal insulation (U-value).

The thermal insulation is usually determined by the overall performance of a glazed element in multiple glazing, defined by the thermal insulation value. It is observed that several factors influence this value. For example, the thermal bridges linked to the glass as is, the points of attachment of the glazing to the bearing structure, the seals distributed over the entire surface of the glazed element and finally the peripheral connecting seals between each glazing commonly referred to as spacers. In the prior art, the thermal improvement in general remains insufficient and the use of such multiple glazings, due to their thickness and their weight, requires the use of a complete support frame, extending over the entire periphery of the glazing, which gives them a good mechanical strength and makes it possible to better insulate the glazing. Nevertheless, the presence of a support frame creates significant bulkiness.

Furthermore, new energy-saving regulations and policies require the manufacture of glazed elements for refrigerated chamber cabinets, the thermal insulation performance of which is continuously improved.

Thus, the invention proposes to replace the conventional insulating glazed elements within a support frame with a glazed element comprising at least one insulating glazing consisting of at least two glass sheets supported by a mobile support that lacks a lateral crosspiece on at least one of the lateral edges, thus having a reduced thickness while giving it a good thermal insulation and a larger transparent surface area.

According to the invention, the glazed element comprises at least two insulating glazings. Thus, when the glazed element is used to close a larger surface area, such as a large-capacity refrigerated cabinet or else a retail display space offering at least two opening leaves, the two multiple glazings being adjoining, the consumer is not visually impeded by the presence of lateral crosspieces. The consumer then has the impression that the refrigerated cabinet lacks opening glazed elements.

The expression "mobile or opening support" is understood to mean the mobile part of the frame that supports the glazing and that makes it possible to open and close the glazed element.

According to one particular embodiment of the invention, the opening mobile support comprises horizontal profiled elements (also referred to as sills or glazing beads) extending over at least one of the upper and/or lower edges of the glazing, which create, with the profiled elements of the fixed support, watertight and airtight barriers.

According to one particular embodiment of the invention, the spacer, the first peripheral seal and the second peripheral seal extending along the lateral edges of said at least two glass sheets within the glazed element according to the invention are formed from a transparent resin.

According to one advantageous embodiment of the invention, the spacer, the first peripheral seal and the second peripheral seal extending along the lateral edge of a glazing which adjoins the lateral edge of the neighboring glazing are formed from a transparent resin and the mobile support separating two neighboring glazings lacks a lateral crosspiece on the lateral edge adjoining the lateral edge of the neighboring glazing.

This has a more pronounced advantage if the glazed elements according to the invention are used for a refrigerated cabinet retail display space. The expression "retail display space" is understood to mean a set of refrigerated cabinets that may be aligned, placed in an L shape, in a Z shape, etc.

The expression "transparent resin" is understood to mean a chemical substance used for the manufacture of a plastic or else the plastic itself, which lets light through and makes it possible to see through.

According to one advantageous implementation of the invention, the spacer is formed from a transparent resin, selected from polymethyl methacrylate, polycarbonate, polystyrene (PS), polyvinyl chloride PVC, acrylonitrile-butadiene-styrene (ABS), nylon or a mixture of these compounds.

Such a spacer has the advantage of opposing possible exchanges of gas, moisture and dust between the external surroundings and the gas-filled cavity of the glazing while being transparent, thus making it possible to see through to the products contained in the refrigerated chamber cabinet without the view of the consumer being obstructed by the presence of a frame or more particularly lateral crosspieces. In the prior art, the spacers used in the insulating multiple glazings are generally an extruded or shaped hollow section made of metal or made of organic material, or else a profile with corner plates or a profile bent at the corners, in this case the spacer consists of a continuous profile bent at the corners.

According to one advantageous implementation of the invention, the first peripheral seal is used between the spacer and each of the glass sheets constituting the glazing. The first peripheral seal, commonly known under the name tightness barrier, is formed from a transparent resin selected from an acrylic or a rubber- or silicone-modified acrylic double-sided tape, more commonly known by the name "double-sided adhesive tape of pressure-sensitive adhesive (PSA) type or transfer tape", or a transparent (butyl rubber) hot-melt adhesive or a structural adhesive of acrylic or epoxy type, optionally crosslinkable under the action of UV rays.

These materials, in addition to being transparent, have a good performance in terms of tightness with respect to water vapor and gases and furthermore have a good adhesion to the glass while withstanding ozone, oxygen and ultraviolet rays.

Conventionally, the peripheral tightness seal is a bead of mastic generally based on polyisobutylene, more commonly referred to as butyl rubber, which is particularly effective in terms of tightness with respect to water vapor and gases, but the mechanical performance of which is insufficient for holding the glass sheets together.

According to one advantageous implementation of the invention, the second peripheral seal, also referred to as an external sealing barrier, which makes it possible to seal the glass sheets together is formed from a resin selected from a glue comprising silicone, hybrid mastic comprising silicone and polyurethane, hot-melt or a mixture of these various compounds.

These compounds have a good adhesion to the glass sheets and mechanical properties that enable them to ensure that the glass components are held against the spacer. These compounds are elastomers that have elastic properties after crosslinking. They have a good oxidation resistance and have a low permeability to water vapor. Silicones, which are one- or two-component elastomers, are particularly preferred due to their adhesion to glass, their resistance to external agents and their aging. Butyl rubbers of "hot melt" type are hot-melt rubbers that have a good resistance to moisture penetration. Their firm consistency at the standard temperatures makes them good candidates as sealing seals.

According to one advantageous implementation of the invention, the spacer, the first peripheral seal and the second peripheral seal extending along the lateral edge of a first glazing which juxtaposes the lateral edge of the neighboring glazing are formed from a transparent resin.

According to one particular embodiment of the invention, the spacer is discontinuous and formed of several portions that may be linked together by a material suitable for ensuring the adhesion of the various portions to one another and the tightness of said glazing. Then a connector, sealed using a weatherstripping product, can be added in order to make it possible to ensure the continuity of the tightness. The tightness of the joints may be reinforced by injection of a weatherstripping product at the four corners.

This has the advantage of being able to use different materials for the various portions of the spacer depending on whether the portion of said spacer positioned on the lateral or lower and upper edges of the glass sheets.

In order to reduce the production costs and according to one advantageous embodiment of the invention, only the spacer, the first peripheral seal and the second peripheral seal extending along the lateral edges of said at least two glass sheets within the glazed element according to the invention are formed from a transparent resin whilst the spacer and the peripheral seals placed on the upper and lower edges are those conventionally used for double or triple glazings, namely butyl rubber as first peripheral seal, a sealing mastic as second peripheral seal and a metal spacer. These various materials are not transparent and are visible to the consumer. When they are used, these elements are then masked by the elements of the mobile support and in particular by sills.

According to one advantageous implementation of the invention, the at least one insulating glazing of the glazed element has a thermal U-value of between 1.6 and 1.8 $W/m^2$. The thermal U-value corresponds to the amount of heat that the material lets through. This type of glass enables a high insulation performance and therefore enables savings in terms of energy and meets the new energy-saving regulations.

According to one particular embodiment of the invention, the at least one insulating glazing comprises at least a first glass sheet and a second glass sheet joined together by means of a spacer, said sheets being of different sizes and may therefore be offset over the entire periphery of the glazing. This is then referred to as asymmetric glazing. This difference in size between the at least first glass sheet and second glass sheet has the advantage of being able to easily implement, on this portion, the mechanical assembling of the sill on the lower and upper edges of a multiple glazing or else of placing therein a heating network which could be deposited on the offset portion of the glass in order to avoid the appearance of condensation at the edge of the glazing.

According to one particular embodiment of the invention, the at least one insulating glazing comprises at least one safety glass sheet.

The expression "safety glass sheet" is understood to mean thermally tempered glasses or else laminated glasses.

This type of glass enables people to be protected against the risk of injury in the case of broken glass.

The invention also relates to the use of an insulating glazed element according to the invention as a door of a refrigerated chamber cabinet.

The invention also relates to a refrigerated chamber cabinet comprising at least one glazed element as described above.

According to one particular implementation of the invention, the refrigerated chamber cabinet comprises at least one glazed element that comprises at least two insulating glazings. According to one particular implementation of the invention, the refrigerated chamber cabinet comprises at least one glazed element that comprises at least two insulating glazings and of which the tightness between the at least two insulating glazings is achieved by means of a transparent sealing element positioned on at least the lateral edge adjoining the lateral edge of the neighboring glazing.

The advantages of these refrigerated chamber cabinets are the same as those of the glazed elements, they are not explained more fully.

5. LIST OF FIGURES

Other features and advantages of the invention will become more clearly apparent on reading the following description of one preferred embodiment, given by way of simple illustrative and nonlimiting example, and from the appended drawings, in which.

6. DESCRIPTION OF ONE EMBODIMENT OF THE INVENTION

Figure 1:
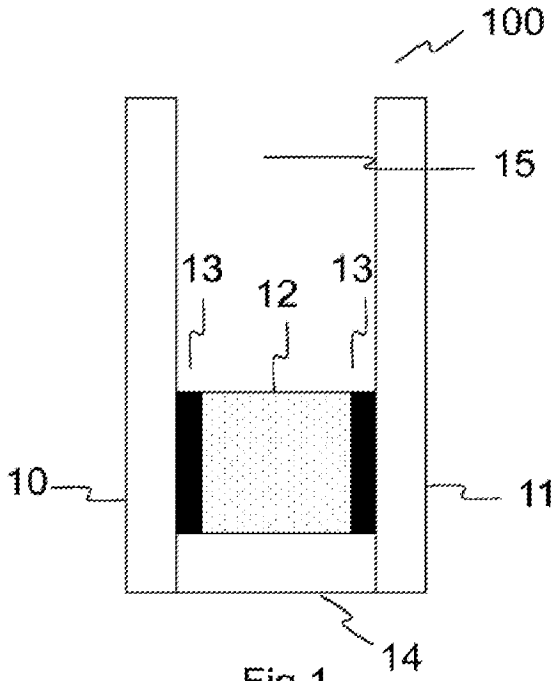
FIG. 1 illustrates an insulating glazing according to the invention.

When products must be stored at a given temperature in a refrigerated cabinet, these products must remain visible to the consumer. For this reason, the cabinets with a refrigerated chamber, also referred to as refrigerated cabinets, used in most commercial premises for offering for sale and/or consumption products that must be kept at given temperatures, are often equipped with glazed elements that convert them into refrigerated display cabinets. Thus, these cabinets allow the products to be viewed by the consumer/customer and allow a self-service use, while guaranteeing that the temperature in the chamber of the cabinet is maintained.

The display of foodstuffs has an essential role in the sale of the products. A good display has in particular a good visibility of the products contained in the refrigerated cabinet. However, while displaying the products, the refrigerated cabinet must maintain a certain temperature and ensure the preservation of the products that must be chilled or frozen.

Refrigerated cabinets are generally in four portions, namely the structure bearing the cabinet, refrigerating elements, the effective sales space, in other words the container, and preferably glazed doors to enable the stocking of the refrigerated cabinet and access by the consumer to the products offered for sale.

The structure bearing the cabinet is mainly composed of an insulated shell in the form of a "steel-insulating foam-steel" sandwich panels. The quality of the implementation and the thickness of the insulating material will determine the energy performance of the cabinet with respect to penetrations (or negative loss). Today, refrigerated cabinets tend to be increasingly attractive by having in particular a bearing structure made of glass. The question of the energy performance then arises. Thus, according to one particular embodiment of the invention, the glazed elements such as for example shown by FIG. 2 may be used to form the doors of the refrigerated chamber cabinet or to form the refrigerated chamber cabinet per se.

The refrigerating elements are generally inside the cabinet.

The invention will be described more particularly for refrigerated chamber cabinets or else refrigerated display cabinets, of upright cabinet shape, but the invention is not limited to these types of cabinets. Indeed, there are several variants of these refrigerated display cabinets. Some are in the form of upright cabinets and then it is the door itself which is a transparent glazed element, others constitute chests and it is the horizontal cover which is glazed in order to allow the contents to be seen, and yet others constitute display case counters and it is the portion that separates the public from the merchandise that is glazed. Irrespective of the variant of these refrigerated display cabinets, it is also possible to produce glazed walls so that the entire contents are visible from the outside.

In display cases of this type, it is necessary for the merchandise to remain completely visible to the clientele so that it is possible to preselect the merchandise without opening the cabinet and to avoid needlessly any loss of energy, therefore resulting in excess energy consumption. Excess energy consumption is often also linked to the use of glazed elements which are not sufficiently insulating. Thus, the glazed portion, more particularly the opening glazed portion of the refrigerated cabinet also referred to as an opening leaf or door of the refrigerated display cabinet should preferably not be delimited by a frame, or at the very least over its lateral edges, in order to give the customer the impression that the cabinet has no opening leaf while performing its thermal insulation role. It is also necessary to avoid the glazed portions of the cabinets and particularly of the doors being covered with condensation and for these glazed portions to withstand the pressures due to the frequent openings/closings of these openings by the clientele or else the employees responsible for stocking the refrigerated cabinets.

Conventionally, the refrigerated cabinet doors comprise a double or triple glazing which requires the use of a support frame that extends over the entire periphery of the glazing in order to give it a good mechanical strength. Unfortunately, this frame, more commonly referred to as a surround frame, in addition to creating significant bulkiness, does not always have good thermal insulation and is not attractive.

Thus, in connection with FIG. 1, an insulating glazing 100 is presented that will be used to manufacture the glazed element 200 according to the invention.

The insulating glazing 100 is a double glazing comprising first and second glass sheets 10, 11 (for example 4 mm-thick soda-lime-silica glass sheets) that are joined together by means of a spacer 12 which keeps them at a certain distance from one another.

Between the two glass sheets 10, 11, an internal space 15 that comprises a cavity filled with an insulating gas and that is closed by first and second peripheral seals 13, 14 positioned around said internal space.

According to the invention, the glass sheets may be of different sizes.

According to the invention, the spacer 12 extending along at least one of the edges of said at least two glass sheets is formed from a transparent resin. According to one preferred implementation of the invention, the spacer formed from a transparent resin is positioned at least on the lateral edge of a glazing which is adjoining the lateral edge of a neighboring glazing in order to ensure a linearity or continuity of the refrigerated chamber cabinet comprising at least two opening leaves. Thus, the customer or employee facing the refrigerated chamber cabinet has the impression that the refrigerated chamber cabinet lacks a glazed element and their view is not impeded by the presence of a frame or lateral crosspieces, whereas the glazed element is indeed present and performs its thermal insulation role.

The spacer used according to the invention may be hollow or solid. It may be of hexagonal shape. In the case where the spacer is hollow, the load with the chambers of the multiple glazing must be balanced. The spacer 12 may in particular comprise a hollow cross section which has, for example, the shape of a square. This section is partially open towards the internal space 15 comprising the insulating gas. A desiccative material may then be positioned inside the spacer 12.

According to one particular implementation of the invention, the spacer 12 may be formed from several portions that may be linked together. Thus, the various portions may be manufactured from different materials.

According to one preferred embodiment of the invention, the spacer 12 placed on the lateral edges of the multiple glazing is formed from a transparent resin whilst the spacer placed on the lower and upper edges of the glazing may not be transparent. The spacer 12 manufactured from a transparent resin is then preferably manufactured from a material selected from polymethyl methacrylate, polycarbonate, polystyrene, polyvinyl chloride PVC, acrylonitrile-butadiene-styrene (ABS), nylon or a mixture of these compounds and the spacers placed on the lower and upper edges, or even on the lateral edge which is not adjoining the lateral edge of a neighboring glazing is a profile made of galvanized steel, aluminum, stainless steel or composites, etc.

According to the invention, the first peripheral seal (13) extending along at least one of the lateral edges of said at least two glass sheets is formed from a transparent resin. According to one preferred implementation of the invention, the first peripheral seal 13 formed from a transparent resin is positioned at least on the lateral edge of a glazing which is adjoining the lateral edge of a neighboring glazing in order to ensure a linearity or continuity of the refrigerated chamber cabinet comprising at least two opening leaves. Thus, the customer or employee facing the refrigerated chamber cabinet has the impression that the refrigerated chamber cabinet lacks a glazed element. According to the invention, the first peripheral seal (13) may be positioned in front of or behind the peripheral seal (14). Such a seal is preferably manufactured from a tightness material selected from an acrylic or a rubber- or silicone-modified acrylic double-sided tape, also known as double-sided adhesive tape "of pressure-sensitive adhesive (PSA) type or transfer tape", or a transparent (butyl rubber) hot-melt adhesive or a structural adhesive of acrylic or epoxy type, optionally crosslinkable under the action of UV rays.

According to the invention, the second peripheral seal (14) may be positioned in front of or behind the peripheral seal (13). The peripheral seal present on at least the lateral edge of an opening leaf which is adjoining the lateral edge of another opening leaf is manufactured from a transparent resin. Such a seal is preferably manufactured from a sealing material is a glue comprising silicone, hybrid mastic comprising silicone and polyurethane, hot-melt adhesive or a mixture of these various compounds.

According to one preferred embodiment of the invention, a desiccative material may be positioned inside the multiple glazing. It may be positioned inside the spacer or at various locations of the glazing such as for example in the glazing bead. Preferably, the desiccative material is incorporated into the space. The dehydration of the air or gas trapped between the glass sheets may be obtained by a desiccant (or dehydrating agent) contained in the tubular spacer. This spacer is then provided with an orifice (slits or holes) in order for the desiccant to be in communication with the internal air or gas. This desiccant is generally a molecular sieve, sometimes silica gel. The absorption capacity of these desiccants is greater than 20% of their weight. After dehydration, in a new insulating glazing, the moisture content is low enough for there to be no condensation between the glasses for temperatures below −60° C. When the spacer or a portion of the spacer is not formed from a transparent resin, then the peripheral seals 13, 14 may comprise tightness layers of polyisobutylene 13 positioned respectively between the spacer 12 and each of the first and second glass sheets 10, 11. The peripheral seal 14 may also comprise a bead of polysulfide or of silicone resin positioned in contact with the tightness layers 13 between each of the glass sheets 10, 11 and the spacer 12.

According to one preferred embodiment of the invention, the internal space 15 comprises a cavity filled with an insulating gas comprising at least 85% of argon or krypton or any other inert gas capable of optimally insulating the glazing. Suitable gases should be colorless, nontoxic, noncorrosive, nonflammable, insensitive to exposure to ultraviolet radiation, denser than air and having a lower thermal conductivity. Argon (Ar), krypton (Kr) and xenon (Xe) are examples of such gases which are commonly substituted for air in insulating glazing panels. It is understood that the internal space 15 may be filled with air.

The use of multiple glazings for refrigerated cabinets is already known. However, the glazings are within a frame in order to maintain a sufficient thermal insulation (U-value), but the thermal improvement in general remains insufficient. Furthermore, the use of such multiple glazings, due to their thickness and their weight, requires the use of a complete support frame over the entire periphery of the glazing, which gives them a good mechanical strength, but which creates significant bulkiness.

Thus, the inventors propose a multiple glazing which may be used in a glazed element suitable for acting as a door or as openings for a refrigerated chamber cabinet without requiring the presence of a mobile support extending over the entire periphery of the glazing.

According to the invention, the glass sheet (10) and (11) respectively in the outer and inner position may be a simple glass sheet of a soda-lime type, a tempered glass or else a laminated glass, a flint glass in order to improve the light transmission, a glass that is optionally bulk-tinted glass, for the esthetic appearance, or a glass on which a scratch-resistant or hydrophobic film may be deposited. Furthermore, functions are increasingly added to these glazings by depositing on their surface thin layers intended to give them a particular property depending on the targeted application. Thus, the glass sheets may be covered, on their outer and/or inner faces, with one or more layers selected from the following list: an anti-fog layer, an antibacterial layer, a hydrophobic layer in order to avoid the stagnation of the water of condensation or else an easy-to-clean layer, a semi-reflective or reflective layer, a low-emissivity layer or else a pyrolytic layer. Thus, layers having an optical function exist, such as the layers known as antireflection layers composed of a stack of layers alternately having high and low refractive indices. For an antistatic function, or a heating function of deicing type, it is also possible to provide electrically conductive thin layers, for example based on a metal or on a metal oxide that is doped. For a thermal, low emissivity or antisolar function for example, it is possible to turn to thin layers made of metal of silver type or based on metal oxide or nitride. In order to avoid condensation, the insulation performance of the glazing has been increased owing to, in particular, the use of double or even triple glazing in order to form the glazed portions of the refrigerated cabinet but also the presence of low-emissivity layers on at least one of the faces of the glass sheets included in the glazing, of thin layers that reflect infrared radiation or else the use of triple glazings, of which one of the gas-filled cavities may be filled with krypton. It is also possible to heat at least some faces of the glazing.

Figure 2:
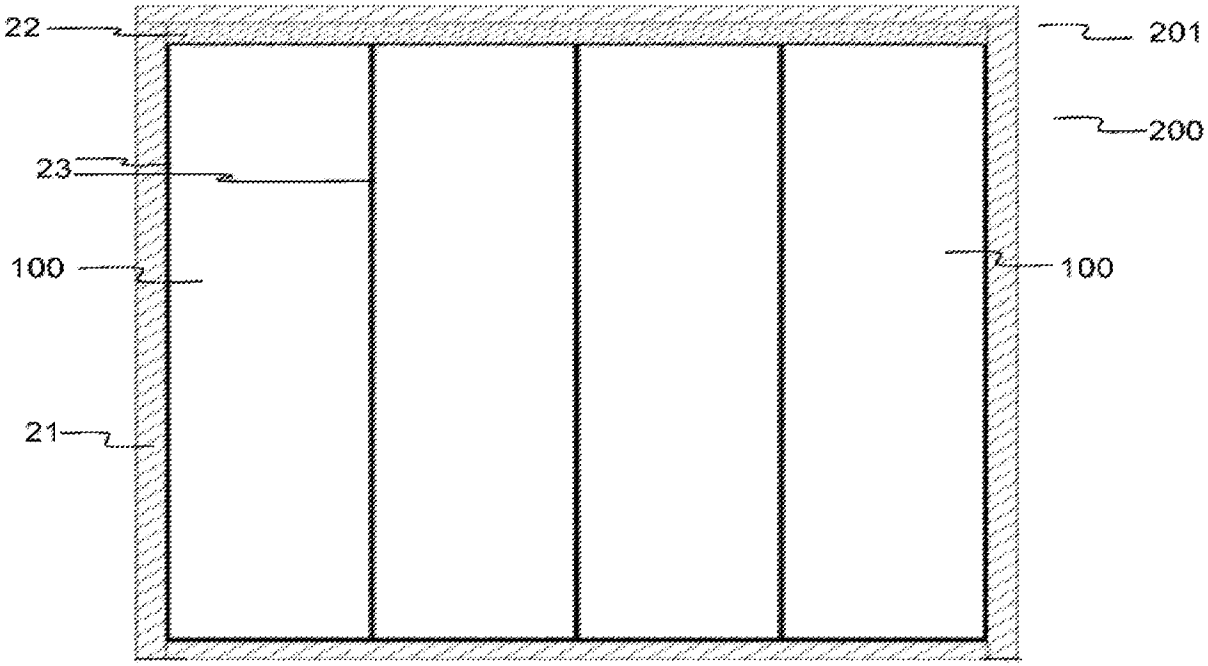
FIG. 2 illustrates a glazed element according to one embodiment of the invention.
Figure 3:
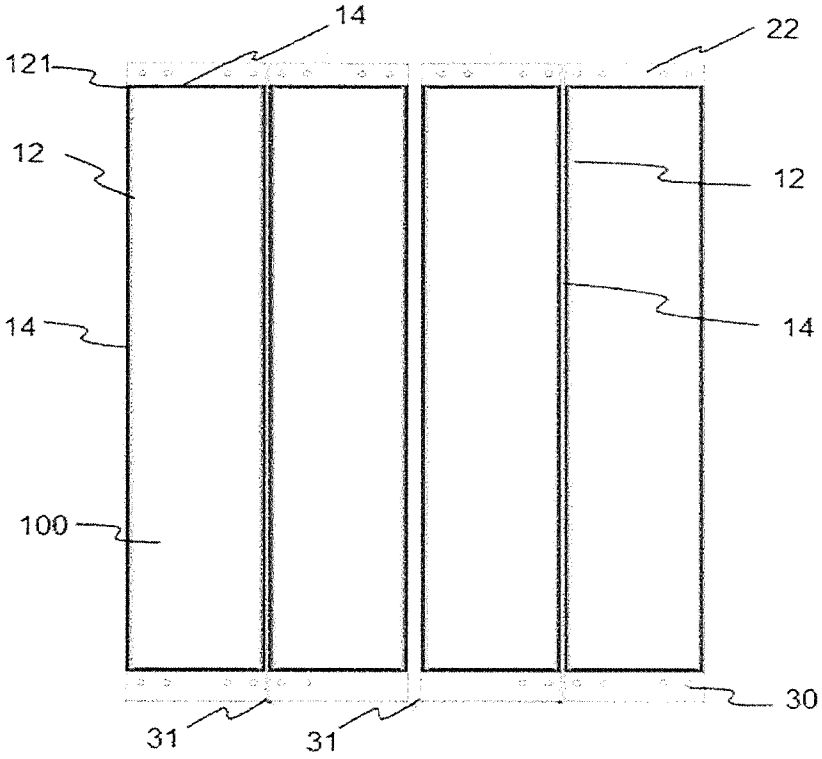
FIG. 3 illustrates the mobile portion of a glazed element according to the invention.

The insulating glazing 100 is thus used to manufacture a glazed element 200 as represented by FIGS. 2 to 4.

Generally, in the multiple glazings comprising two or even three or more glass sheets, the spacer is attached inside the insulating glazing via its lateral faces to the internal faces of the glass sheets by butyl rubber which has the role of making the inside of the glazing water vapor tight. The spacer is positioned set back inside the glazing and in the vicinity of the edges of said glass sheets, so as to make a peripheral groove injected into which are the sealing means of mastic type, such as a polysulfide or polyurethane. The mastic reinforces the mechanical assembly of the two glass sheets and provides liquid water and solvents tightness. This colored spacer and also the sealing means are not attractive and are generally masked by an outer frame in which the glazing lies. However, this visible frame represents a visual barrier, an impediment to the access to the merchandise contained in the refrigerated cabinet. This frame not only has an esthetic role but also a thermal insulation role. It should generally be weakly conductive.

Conventionally, the framework comprises various parts including:

- the fixed support, also referred to as a fixed frame, which is a base constituent element of the framework, represents the part of the framework fixed to the load-bearing structure of the refrigerated cabinet. It generally comprises the glazing bead for attachment of the glazing,
- the mobile support, also referred to as an opening frame, which is the mobile part of the framework. It generally comprises the tightness seals against air. The fixed support then comprises profiles that create, with those of the opening leaf, barriers to water and air. Housings for the hardware are also provided therein.

Generally, the fixed and mobile supports are composed of upper and lower edges and lateral (right and left) crosspieces. This configuration makes it possible to support the insulating glazing but also to contribute to the thermal insulation.

The frameworks are generally manufactured from various materials such as wood, PVC (polyvinyl chloride), aluminum or else composite materials.

The invention therefore proposes a glazed element 200 comprising at least one multiple glazing 100 supported by at least one framework, of which the mobile support or opening frame, also referred to as the opening leaf, lacks lateral crosspieces covering at least the lateral edge of the glazing adjoining the lateral edge of the neighboring glazing.

The structure of the glazing used for the glazed portions and in particular the opening leaves of the refrigerated chamber cabinet according to the invention has the advantage of conferring a rigidity and a strength that are equivalent to those of a single glazing even though said glazing lacks mobile support over the whole of the periphery of the glazing or more particularly lateral crosspieces extending along at least the lateral edges while guaranteeing good thermal insulation. Thus, the bulkiness is greatly decreased thus offering a greater visibility of the contents of the refrigerated cabinet. The use of an opening leaf without a mobile support is even more astonishing since the main role of a mobile support of a door or a window or an opening leaf in general, is to hold the glazing in place and to enable opening, maintenance and ventilation. Especially as the structure of the support frame takes up the weight of the elements constituting the glazing, the weather loadings and maintenance loadings, and also of certain accessories and transfers it to the lateral walls of the refrigerated cabinet, to which walls the support frame must be correctly anchored in order to take on/withstand the pressure forces. Furthermore, it is not sufficient for the mobile support to have the strength necessary for constituting an effective support for the glazing, it is also necessary for the weight thereof to be transferred to carefully chosen locations in order to avoid excessive deformation of the opening frames and fixed crosspieces. Generally, a weakly conductive support frame made of wood, aluminum or PVC is used to support a multiple glazing.

However, the use of such an insulating glazing without a mobile support over the entire periphery of the glazing is not without consequences as regards the structure itself of the refrigerated chamber cabinet, in particular when it is a cabinet in which the internal ambient temperature is greatly different from the external ambient temperature. Thus, in order to ensure an optimal thermal insulation, the glazing 100 has a coefficient of heat transmission U-value of between 1.6 and 1.8.

The heat transmission U-value is understood to mean the amount of heat passing through the glazing, in steady state, per unit area, for a difference of one degree Celsius between the surroundings, for example outside and inside. These U-values are in particular achieved owing to a low-emissivity layer (low-E layer). For example, the glass sheets used may be glass sheets of Thermobel TopN or TopT type from ΔGC. The glass sheet may thus be covered with thin layers made of metal of silver type or based on metal oxide or nitride. Thus, the glazing 100 used has a very efficient U-value while exhibiting esthetic qualities.

Next, the use of insulating glazing according to the invention makes it possible to produce a better thermal insulation than the customary insulating glazings, for a smaller thickness and a lower weight, and consequently to make a saving in terms of energy consumption.

The invention relates more particularly to a refrigerated chamber cabinet in which fresh, refrigerated or frozen products are displayed, the usual name of which is a "refrigerated display cabinet". It is understood that the invention is not limited to this type of cabinet, any cabinet with a chamber having a hot, wet or dry atmosphere also comes under the scope of the invention.

Another subject of the invention is a refrigerated chamber cabinet that overcomes the various drawbacks of the prior art, and that meets the tightness criteria for cabinets of this type and that offers a cabinet that is easy to use and economically advantageous.

The refrigerated chamber cabinet according to the invention has the advantage of providing the customer with increased visibility of its contents since the opening leaves lack a support frame over at least one of the lateral edges of the glazing panel, while guaranteeing a good thermal insulation.

The glazed element for producing such a refrigerated cabinet is described above and represented by way of example by FIGS. 2 and 3.

Figure 4B:
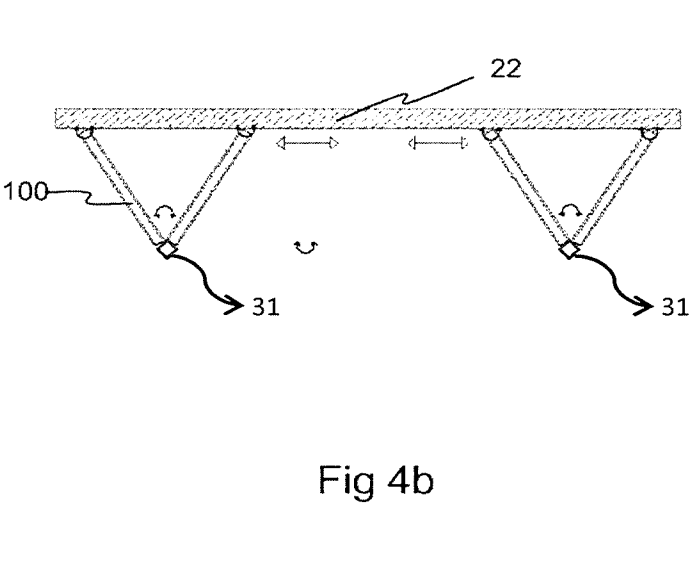
FIG. 4*b* represents a top view of a glazed element, the mobile portions of which are open.
Figure 4A:
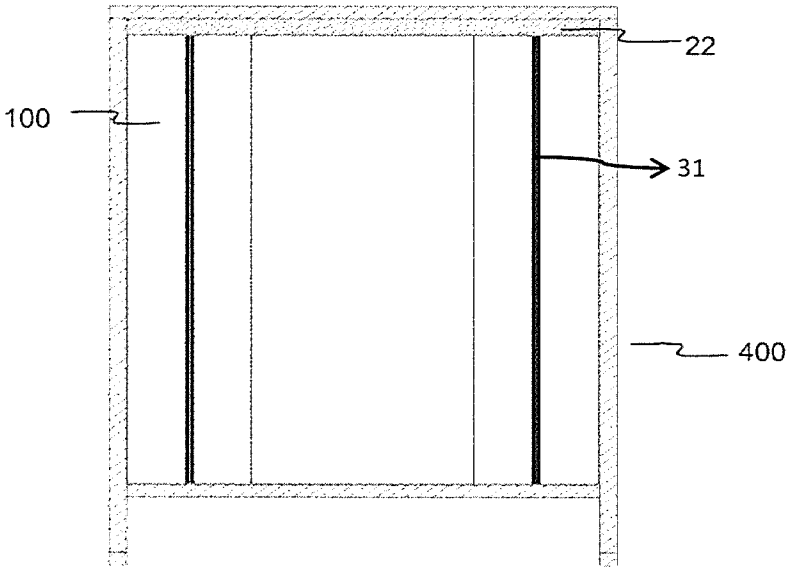
FIG. 4*a* presents an example in which the glazed element according to the invention is integrated into a refrigerated chamber cabinet.

According to one particular embodiment of the invention as shown in FIG. 3 and FIGS. 4*a* and 4*b*, the tightness between the two opening leaves is achieved by means of a transparent sealing element 31 attached to the glazing. The tightness is for example provided on the lateral edges without a lateral crosspiece by a transparent lip seal or flange seal or a seal of brush or felt type on the lower and upper edges of the glazing. Preferably, the insulating glazing is provided on at least one of its edges with a transparent sealing element such as an adhesively bonded profile, in particular made of plastic. The term "profile" is understood to mean prefabricated profiles of all types having a shape suitable for the function of said profile. Preferably, the profile is a plastic profile in order to be able to take up the deformation of the glazing without large stresses. Such a profile adhesively bonded to at least one of the edges of the glazing may fulfil various functions such as the protection of the edges of the glazing, the attachment of various elements such as hinges or handles or else the esthetic appearance of the opening leaf. Furthermore, the use of a profile is advantageous for the production of the magnetic contacts between the opening leaf and the cabinet and/or the neighboring opening leaf.

Thus, compared to conventional refrigerated chamber cabinets, the vertical elements for receiving the lateral edges of the at least two opening leaves are eliminated, the lateral edges being those which are not attached along the edges to the walls of the cabinet. The vertical elements on which the opening leaf came into abutment so that the tightness and the blocking of the opening leaves are ensured. The absence of the vertical elements makes it possible to simplify the structure of the cabinet while improving its esthetic appearance.

According to one advantageous embodiment of the invention, said sealing element placed on the lateral edges of the glazing is a transparent lip seal or flange seal which has the advantage of not creating resistance stresses in the glazing and of not creating a risk of a break in the tightness over the entire length.

Preferably, the lower and upper corners of the glazing are equipped with an element capable of receiving a magnetic part in order to ensure contact with the cabinet and/or the edge of the neighboring opening leaf. Thus, good contact and good abutment is achieved between the jamb and the cabinet and the neighboring jamb while enabling a hermetic and esthetic closing of said opening leaf.

According to one advantageous variant of the invention, the tightness between the opening leaf and the upper and lower edges of the cabinet is achieved by means of compressible magnetic tightness seals positioned on said edges of the cabinet so that the contact is achieved at the periphery of the opening leaf.

In this way, the internal surface of the opening leaf is lightened and the compressible magnetic tightness seal allows hermetic contact that absorbs the slight deformation which may appear over this contact length. Indeed, since this contact length is shorter than that at the lateral ends of the cabinet, the deformation bowing is much smaller and the contact may be achieved over the periphery of the opening leaf without risk of a break in the tightness.

According to one advantageous variant of the invention, the pivot pin is off-center with respect to the plane of said opening leaf and the pivoting element is adhesively bonded to the opening leaf.

According to one variant of the invention, the insulating glazing has glass sheets of different sizes over the entire periphery of the glazing. The asymmetry of the two glass sheets facilitates the mechanical assembling of the sill on the lower and upper edges of a multiple glazing and in particular of the double glazing within the opening leaf.

According to one particular embodiment of the invention, the opening leaf is provided with a return element of rod-spring type. Such an embodiment is particularly advantageous from an esthetic viewpoint. Indeed, it makes it possible to eliminate the use of the torsion bars customarily used, these bars generally being positioned in the support frame due to their considerable volume.

These types of assemblies have numerous advantages. Firstly, due to the stiffness and mechanical strength of the insulating glazing, it is not necessary to join the insulating glazing to a support frame over the entire periphery of the glazing as in standard multiple glazings, which support frame substantially increases the general bulkiness of the opening leaves and therefore consequently that of the cabinet.

According to one preferred embodiment of the invention, a lower and upper sill 22 are positioned on the lower and upper edges of the multiple glazing in order to be able to hold and attach the opening leaf to the fixed frame part, that is to say the fixed support for the opening leaf of the refrigerated chamber cabinet.

The sill 22 may be made of aluminum, PVC, steel, stainless steel or else any material suitable for fulfilling this function of holding and attaching the glazing to the fixed frame part. The sill must have the lowest possible U-value in order to prevent heat losses. Owing to the stills, the transfer of the mechanical load by the glass takes place between the lower and upper parts of the multiple glazing, but also by the frame. Such a sill is presented in FIG. 3.

Glazing beads made of glass may be used along the lower and upper edges enabling the multiple glazing to be held at the sill.

The glazing bead may be attached by adhesive bonding, clip fastening or screwing.

A "sill or glazing bead" is understood to mean a section of small cross section that is used to attach, hold, transfer the weight of the glazing to the fixed support and the refrigerated chamber cabinet and position the glazings. Its height generally levels that of the glass sheets. It must be able to be disassembled to enable the replacement of the glazing if this must be replaced. There are many systems for attaching the glazing beads. It may be attached by tack welding or screwing, by clip fastening to studs, by clip fastening to springs or grooves or by screwing against the inner face of the glazing in order to facilitate the placement and removal of the latter, to a fixed or opening section. The glazing bead generally takes the form of a small-sized wooden rod, or a metal or PVC profile that is used to hold the glazing in the rabbets of a framework.

The presence of sills on the lower and upper edges of the multiple glazing allows incorporation of at least one portion of the mechanism intended to enable the opening and closing of the opening leaves, and in particular the attachment of two, three or even four bearing or pivot points, which are mainly anchoring points for the opening and closing movements of the opening leaves. The mechanism intended to enable the opening and closing of the opening leaves is, according to one particular embodiment of the invention, composed of several parts that make it possible to connect the opening leaf to the cabinet with a refrigerated chamber and more particularly to connect it to the fixed support.

It is understood that the fixed support may be the frame of the refrigerated chamber cabinet.

According to one advantageous implementation of the invention, a damping abutment system for closing the opening leaf and/or keeping it in the open position may be placed on or in at least one of the sills.

According to another advantageous embodiment of the invention, a desiccative material may be incorporated into at least one of the sills.

According to one advantageous implementation of the invention, at least one of the sills may comprise a tightness barrier that comes into abutment with the door when it is in the closed position. The tightness barrier may in particular be a flange seal, lip seal, brush seal or felt seal.

According to one particular embodiment of the invention, the refrigerated cabinet is capable of receiving the fixed support of the glazed element according to the invention.

The expression "fixed support" is understood to mean the part of the frame which is fixed to the refrigerated chamber cabinet and that will support the opening leaf when it is in both the open and closed positions. The fixed support may be made of aluminum, PVC, steel or else wood. The fixed frame will in particular comprise a portion of the mechanism intended to enable the opening and closing of the opening leaves, the other portion being fixed to the opening leaf and according to one particular embodiment of the invention, to the other portion of the mechanism for opening and closing the opening leaf placed on at least one of the two sills. Thus, the fixed frame may comprise 2, 3 or 4 bearing or pivot points, and the electrical or pneumatic movement control mechanism of jackscrew type with or without shafts.

The fixed support may in particular comprise a damping abutment for closing the opening and keeping it in the open position. Preferably, a tightness barrier is placed around the perimeter of the fixed frame. Such a barrier may be of flange seal, lip seal, brush seal or felt seal type in abutment with the door in the closed position.

According to the invention, the opening leaves of the refrigerated cabinet may be opened in various ways. Thus, the opening leaves may be opened by simple pivoting from the inside to the outside. The opening leaves may also be opened by sliding the opening leaves from the right to the left or from the left to the right by horizontal translation with or without overlapping of one of the opening leaves over the others. The opening leaves may also open by concertina-style opening.

When the glazed element is used as a door for a refrigerated cabinet, the doors opening from the inside to the outside, then the cabinet preferably lacks vertical internal intermediate jambs extending over the height of the cabinet on which the opening leaf would come into abutment so that the tightness is achieved.

The opening and the closing of the mobile portion of the glazed element according to the invention is preferably automated, that is to say controlled by means of an electrical system.

According to one particular embodiment of the invention, the refrigerated chamber cabinet may be equipped with a system of internal lighting of the multiple glazing. The lighting may be produced in particular owing to LEDs positioned on at least one of the lower or upper edges of the glazing, a light may also be projected into the field of vision of the glass panel(s) constituting the multiple glazing.

Video or stationary billboards may be incorporated inside the multiple glazing and in particular inside double or triple glazing. Electrically- or mechanically-controlled blinds may be added to the refrigerated chamber cabinet.

This type of refrigerated chamber cabinet thus described is easy to produce and to install since it does not require very many parts. It provides incontestable thermal insulation and also very good tightness while having an esthetic appearance.

By way of example, FIGS. 2 to 4 represent a glazed element according to the invention. More particularly, FIG. 2 shows a glazed element comprising 4 insulating double glazings 100, numbered from 1 to 4 going from the left to the right, attached to the fixed support by means of pivot hinges positioned on the lateral edges of the glazings 1 and 4. The glazings are connected together by double pivots positioned on the upper and lower corners of the glazings. The opening of the mobile portions is a concertina-style opening (FIGS. 4*a* and 4*b*). A system of translation/rotation is placed respectively on the right and left upper edges of glazings nos. 2 and 3 thus enabling an opening of the opening portions, the opening portions being formed from two insulating glazings 100. The glazings 1 and 4 comprise two asymmetrical tempered soda-lime type glass sheets, whereas the glazings nos. 2 and 4 comprise two tempered glass sheets of identical size. The glass sheets are covered on their internal face with a low-emissivity layer of TopNT type from AGC. The internal space between the 2 glass sheets comprises argon as insulating gas. The insulating glazings 100 are attached on their upper edge to the upper and lower part of the fixed support by means of rails for upper translation and sills 22 positioned on the upper and lower edges of the glazings 100. The opening of the doors is automated. The tightness between the insulating glazings themselves and the glazings and the fixed support is provided by transparent bulb seals. The spacer 12 separating the two glass sheets of each glazing 100 and placed along the lateral edges of the glazings is a transparent polycarbonate rod adhesively bonded to the glass sheets by means of a peripheral seal 13 which is a transparent double-sided adhesive tape of PSA type. The gas tightness between the glass sheets is ensured by a transparent silicone glue 14 positioned along the spacer. The portion of the spacer 12 placed on the upper and lower edges of the insulating glazings 100 is an aluminum rod comprising a molecular sieve such as a silica gel.

The refrigerated chamber cabinet according to the invention makes it possible furthermore to improve the external esthetic appearance of these cabinets. Thus, the face of the cabinet comprising the opening leaves may be almost completely made of glass due to the absence of support frames around the entire periphery of the glazing and it is possible to provide a small space between the opening leaves without obstructing the visibility of the contents inside these cabinets and without obstructing the opening and closing of the cabinet.

The refrigerated chamber cabinet according to the invention makes it possible to meet the tightness criteria required for these types of cabinets, and are easy to produce, this being achieved without increasing, or even by decreasing, the production costs of the cabinets.

The invention is not limited to this particular type of embodiment and should be interpreted in a nonlimiting manner that encompasses any type of refrigerated chamber cabinet comprising at least two opening leaves that comprise at least one insulating glazing composed of at least a first glass sheet and a second glass sheet. Furthermore, a person skilled in the art will be able to add any variant to the insulating glazings according to the invention described in the preceding figures. For example, the insulating glazing may comprise several internal spaces each comprising a cavity filled with an insulating gas (e.g. triple glazing), the glass sheets of the insulating glazing panels according to the invention may consist of any type of glass, may be surface-textured, may comprise coatings of any type intended to carry out any function, or may themselves consist of glazing panels laminated by means of plastic interlayers. The insulating glazing may also be a glazing of VIG type, that is to say a glazing obtained by applying a vacuum between the glass sheets. A glazed element according to the invention may be used in any type of application such as the doors of refrigerated cabinets, freezers, glazed bays (e.g. verandas, roof elements, etc.).

The invention claimed is:

1. A glazed element comprising:

a. at least one insulating glazing comprising at least a first glass sheet and a second glass sheet joined together by means of a spacer which keeps them at a certain distance from one another, said spacer extending along lateral, upper and lower edges of said at least two glass sheets and, between said at least two glass sheets, at least one internal space that comprises a cavity filled with an insulating gas and that is closed by a first peripheral seal and a second peripheral seal that are positioned around said internal space, b. at least one frame that supports said at least one insulating glazing, said frame comprising:

i. a fixed support and ii. a mobile support hinged to the fixed support that enables opening and closing of the glazed element, wherein the spacer, the first peripheral seal and the second peripheral seal extending along at least one of the lateral edges of said at least two glass sheets are formed from a transparent resin, and said mobile support lacks at least one lateral crosspiece.

2. The glazed element according to claim 1, wherein the glazed element comprises at least two insulating glazings.

3. The glazed element according to claim 1, wherein the spacer, the first peripheral seal and the second peripheral seal extending along the lateral edges of said at least two glass sheets are formed from a transparent resin.

4. The glazed element according to claim 1, wherein the spacer, the first peripheral seal and the second peripheral seal extending along the lateral edge of a first glazing which juxtaposes the lateral edge of the neighboring glazing are formed from a transparent resin and in that the mobile support separates two neighboring glazings and lacks a lateral crosspiece on a lateral edge adjoining a lateral edge of the neighboring glazing.

5. The glazed element according to claim 1, wherein the spacer is discontinuous and formed of several portions that may be linked together by a material suitable for ensuring the adhesion of said portions to one another and the tightness of said glazing.

6. The glazed element according to claim 1, wherein the spacer is formed from a transparent resin, selected from polymethyl methacrylate, polycarbonate, polystyrene, polyvinyl chloride PVC, acrylonitrile-butadiene-styrene, nylon or a mixture of these compounds.

7. The glazed element according to claim 1, wherein the first peripheral seal is a tightness seal selected from an acrylic or a rubber- or silicone-modified acrylic double-sided tape, or a transparent hot-melt adhesive or a structural adhesive of acrylic or epoxy type, optionally crosslinkable under the action of UV rays.

8. The glazed element according to claim 1, wherein the second peripheral seal is a glue comprising silicone, hybrid mastic comprising silicone and polyurethane, hot-melt or a mixture of these various compounds.

9. The glazed element according to claim 1, wherein the glazing has a thermal U-value of between 1.6 and 1.8.

10. The glazed element according to claim 1, wherein said first and second glass sheets are of different sizes.

11. The glazed element according to claim 1, wherein the insulating glazing comprises at least one tempered or safety glass sheet.

12. A refrigerated chamber cabinet comprising at least one glazed element according to claim 1.

13. The refrigerated chamber cabinet according to claim 12, wherein the glazed element comprises at least two insulating glazings.

14. The refrigerated chamber cabinet according to claim 13, wherein a tightness between the at least two insulating glazings is achieved by means of a transparent sealing element positioned on at least the lateral edge adjoining the lateral edge of the neighboring glazing.

* * * * *